US005582561A

United States Patent [19]

Gonzalez

[11] Patent Number: 5,582,561

[45] Date of Patent: Dec. 10, 1996

[54] BOXING AND MARTIAL ARTS TRAINING DEVICE

[76] Inventor: E. H. Gonzalez, P.O. Box 13931, Tucson, Ariz. 85732

[21] Appl. No.: 493,898

[22] Filed: Jun. 23, 1995

Related U.S. Application Data

[63] Continuation-in-part of Ser. No. 263,732, Jun. 21, 1994, abandoned.

[51] Int. Cl.[6] ..... A63B 69/00; A63B 21/00

[52] U.S. Cl. ..... 482/83; 482/54; 482/147; 482/87

[58] Field of Search ..... 482/83–90, 53, 482/54, 72, 142, 147

[56] References Cited

U.S. PATENT DOCUMENTS

| | | | |
|---|---|---|---|
| 3,384,369 | 5/1968 | Rumell | 482/147 |
| 3,411,497 | 11/1968 | Rickey et al. | 482/87 |
| 3,911,907 | 10/1975 | Smith, Jr. | 482/147 |
| 4,386,915 | 6/1983 | Gilliam . | |
| 4,390,180 | 6/1983 | Simjian . | |
| 4,743,008 | 5/1988 | Fermaglish . | |
| 5,135,458 | 8/1992 | Huang . | |
| 5,242,340 | 9/1993 | Jerome | 482/147 |
| 5,284,461 | 2/1994 | Wilkinson et al. . | |
| 5,320,594 | 6/1994 | Huang | 482/147 |
| 5,372,560 | 12/1994 | Chang | 482/54 |
| 5,407,408 | 4/1995 | Wilkinson | 482/54 |
| 5,492,521 | 2/1996 | Wilkinson | 482/54 |

FOREIGN PATENT DOCUMENTS

| | | | |
|---|---|---|---|
| 1155277 | 5/1985 | U.S.S.R. | 482/147 |

*Primary Examiner*—Jerome Donnelly
*Attorney, Agent, or Firm*—Richard C. Litman

[57] ABSTRACT

A boxing and martial arts training device including a punching bag and a rotatable foot platform. The foot platform includes a treadmill. Rotation of the foot platform and operation of the treadmill are independently controlled from a hand held switch wired to motors located below the foot platform. The punching bag is supported on a frustoconical backboard. Height of the punching bag and its proximity to the center of the foot platform are manually adjustable. The training device simultaneously promotes strength, balance, coordination, and physical conditioning.

12 Claims, 3 Drawing Sheets

BOXING AND MARTIAL ARTS TRAINING DEVICE

CROSS REFERENCE TO RELATED APPLICATION

This application is a Continuation-in-Part of Ser. No. 08/263,732, filed Jun. 21, 1994. Now Abandoned

BACKGROUND OF THE INVENTION

1. Field of the Invention

The present invention relates to a training device for use by boxers and those engaging in martial arts. The device provides a punching bag and a rotating platform incorporating a reversible treadmill on which the boxer stands while practicing maneuvers. A user learns to coordinate complex leg motions while using his or her arms, and improves physical condition while so doing.

2. Description of the Prior Art

Boxing and the martial arts require carefully coordinated arm motions and complementary leg motions for success in the endeavor. Since many individual movements must be practiced at great length to impart necessary accuracy of motion, and to accustom the practitioner to maintain balance, most practitioners practice solo, on a ground or floor surface. While this type of practice enables an individual to progress in perfecting individual movements, it falls short in enabling the user to adapt his or her newly developed skills to a real match which includes a live opponent.

In particular, unlike the relatively static practice conditions, in a live match, the practitioner must cope with an opponent who may be initiating offensive or defensive maneuvers which may render the practitioner vulnerable to attack, or which may render the practitioner's movements ineffective. It therefore becomes desirable to provide a practice environment which better simulates actual hand to hand contests.

Solo practice also does not force the practitioner to react, to maintain balance while reacting, and does not maximize physical conditioning.

A standing platform which rotates and incorporates a treadmill vastly increases the demands made on a practitioner during practice, and requires relatively life-like responses to the changing conditions. This combination of foot motions has been proposed in the prior art.

In U.S. Pat. No. 4,743,008, issued to Daniel R. Fermaglish et al. on May 10, 1988, a treadmill is combined with a rotary table to enable an infant to practice walking. Rotation of the table and operation of the treadmill may occur simultaneously. There is no structure concerned specifically with arm movements.

A number of patents combine a variable motion platform on which the user stands with auxiliary equipment for the hands. Examples are seen in U.S. Pat. No. 4,386,915, issued to Barry R. Gilliam on Jun. 7, 1983, U.S. Pat. No. 4,390,180, issued to Luther G. Simjian on Jun. 28, 1983, U.S. Pat. No. 5,135,458, issued to Chin H. Huang on Aug. 4, 1992, and U.S. Pat. No. 5,284,461, issued to William T. Wilkinson et al. on Feb. 8, 1994. In each example of this latter group, one or two handles are grasped by the user. There is no target object equivalent to a punching bag for striking. Also, the above devices are manually operated rather than being motorized, and all therefore lack controls for remotely influencing platform rotation and treadmill operation.

None of the above inventions and patents, taken either singly or in combination, is seen to describe the instant invention as claimed.

SUMMARY OF THE INVENTION

The present invention provides an exercising and training aid for the martial arts, encompassing boxing as well as arts of Oriental derivation. The aid combines a punching bag, which will be understood to encompass speed bags, martial arts bags, and like flexible target objects for receiving blows, with a movable foot platform. The foot platform is movable with respect to a solid or stationary floor surface. The foot platform has an eye for anchoring a double ended martial arts bag.

Two different types of motion are provided, those being rotation about a vertical axis, and movement of a treadmill incorporated into the platform. Rotation may be clockwise or counterclockwise, as desired. The treadmill is operated, selectively, in both directions. Rotation and treadmill operation are independently controlled, and both may occur simultaneously if desired.

The resultant conditions more closely simulate the actual sports of boxing or martial arts than are possible with solo practice on a solid floor, with or without a punching bag, and with or without a prior art foot platform. The benefits include simultaneous development of strength, endurance, balance, and coordination. Since all areas of martial arts skills are provided in the same activity, there is an attendant savings in time and in equipment requirements.

The height of the punching bag and its proximity to the vertical centerline of the foot platform are adjustable. Combined with independent control of platform rotation and treadmill operation, a considerable degree of accommodation of individual needs is provided.

The punching bag has a frustoconical backboard. This configuration minimizes the likelihood of impact of a user's hand or foot therewith during practice.

Accordingly, it is a principal object of the invention to provide, in combination, a punching bag and a movable foot platform.

It is another object of the invention to enable simultaneous development of strength, endurance, balance, and coordination.

It is a further object of the invention to enable practice which simulates closely the actual sports of boxing and of martial arts.

Still another object of the invention is to minimize time and equipment requirements of martial arts training.

An additional object of the invention is to enable adjustments to the height and location of the punching bag.

It is again an object of the invention to vary the nature of motion at the floor platform as desired.

Yet another object of the invention is to provide a backboard for the punching bag which minimizes likelihood of impact of a user's hand or foot therewith during practice.

Still a further object of the invention is to enable fastening thereto of a double ended martial arts bag.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
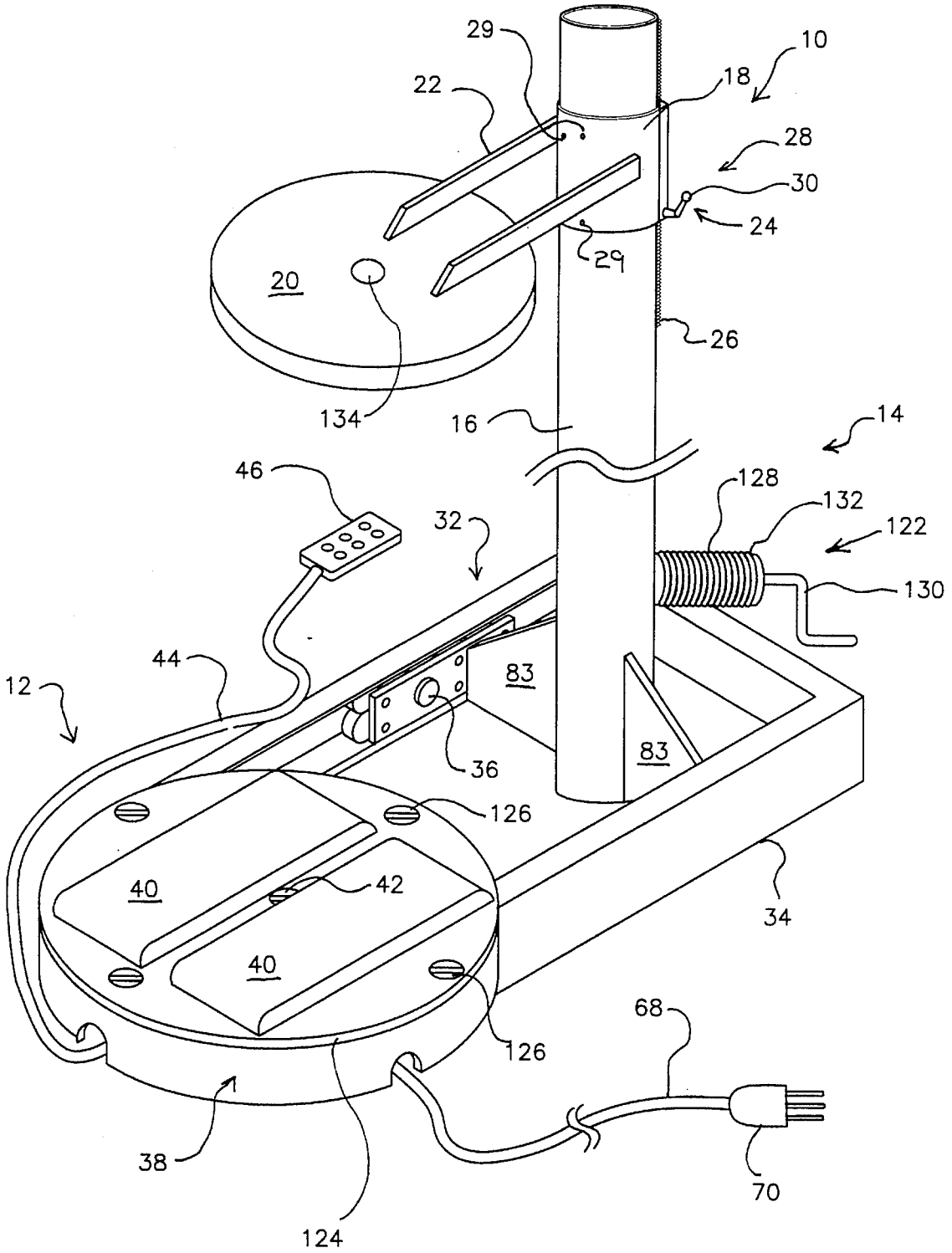
FIG. 1 is a perspective view of the invention.
Figure 2:
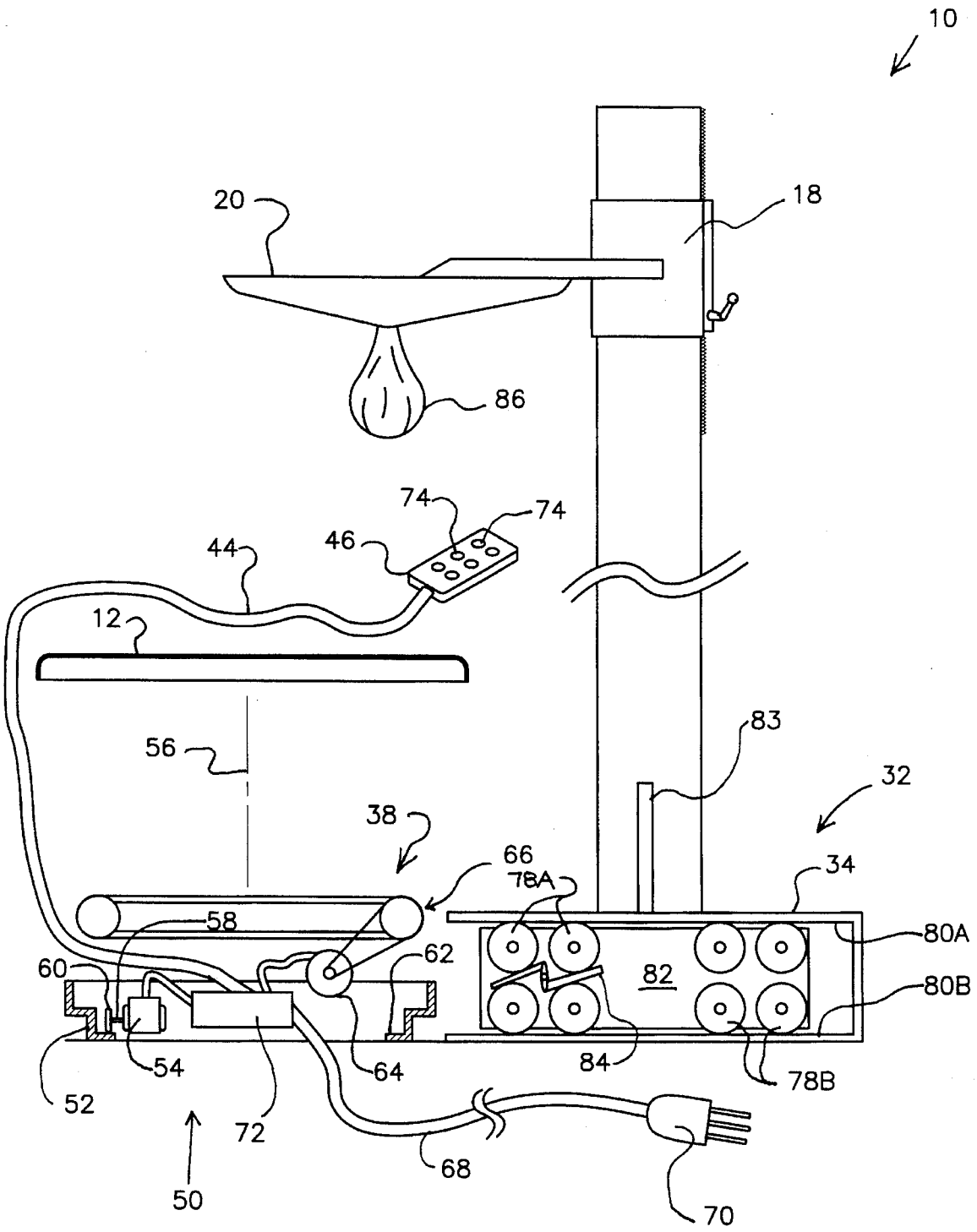
FIG. 2 is a side elevational view of the invention, partly in cross section and partly exploded.

FIG. 1 shows the inventive training aid 10 to include a foot platform 12 and a support member 14 for attachment of a punching bag (shown in FIG. 2). Support member 14 includes a vertical mast 16 having a collar or sleeve 18 adjustably mounted thereto. A backboard 20 is suspended from sleeve 18 by a supporting frame 22.

Backboard 20 and its punching bag will therefore be vertically adjusted with respect to foot platform 12 by moving sleeve 18 along mast 16. Adjustment is accomplished by a gear assembly 24 having a toothed rack 26 mounted vertically on mast 16, which rack 26 cooperates with a gear 28 fixed to sleeve 18.

Gear 28, which is concealed within gear assembly 24, is any suitable well known type of gear, preferably a worm gear. A worm gear resists unintended lowering of sleeve 18. Therefore, while another type of gear may be substituted, such substitution would likely require a manual locking device to secure sleeve 18. Manual locking may be accomplish by providing locking screws 29 which, when tightened, impart a normal force on sleeve 18 to secure the sleeve to mast 16. Gear 28 is adjusted by turning handle 30 so that sleeve 18, and consequently, backboard 20 and the punching bag, are all located at a predetermined desired height above foot platform 12.

A track and roller assembly 32 is fixed to foot platform 12, and adjustably receives support member 14. Assembly 32 extends horizontally from foot platform 12, supported on the floor surface (not shown) supporting training aid 10. Support member 14 moves along track 34 toward and away from foot platform 12. Combined with the height adjustment described above, horizontal adjustment of support member 14 enables a punching bag to be located at any desired point from foot platform 12, within the mechanical limits of adjustment.

A knob 36 controls a locking assembly (shown in FIG. 2) to maintain support member 14 at a selected position along track 34.

The arrangement of rollers and track is, of course, only one way of providing adjustable securement of supporting member 14. Another arrangement, not illustrated, could include screws journaled in track 34 and passing through threaded holes formed in mast 16. This arrangement would have the inherent characteristic of resisting unintended movement of support member 14 along track 34.

Still another possibility would be to provide a flange projecting from mast 16, which would ride in partially surrounding grooves formed in track 34. The latter arrangement would include lubrication of contact between flange and grooves, such as by providing grease or a similar fluent lubricant, by coating either or both of the contacting members with a low friction material such as polytetrafluoroethylene, or by a combination thereof.

Looking now at foot platform 12, it will be seen that a two part treadmill 38 projects upwardly through platform 12.

Treadmill 38 may be of any suitable type well known in exercising equipment. Two tracks 40 are provided to expose space therebetween. This space provides access to an eye 42 located below the top surface of foot platform 12, so that a double ended martial arts bag (not shown) may be secured thereto. Eye 42 is of conventional nature, intended for attachment of conventional punching bags. If employed in place of a standard punching bag, the double ended bag would be anchored at backboard 20 and also at foot platform 12.

Eye 42 is preferably anchored to a stationary part of training aid 10 below foot platform 12, as will be described hereinafter.

A flexible cable 44 passes through an opening in the base of the foot platform 12. Cable 44 is connected to a hand-held, mobile controller 46 provided to control rotation of foot platform 12 and operation of treadmill 38. Cable 44 enables controller 46 to be grasped in the idle hand of the user while employing training aid 10.

Operation of the controls and of track and roller assembly 32 will now be described, with reference to FIG. 2. In this Figure, foot platform 12 is seen to be a rotatable member supported on a stationary frame or base 50. Base 50 includes structural members 52 which support mobile components of foot platform 12 and which also provide track 34.

A motor 54 rotates foot platform 12 about a vertical axis 56 by the following arrangement. Shaft 58 of motor 54 is fastened to a drive wheel 60, which rides on a circular track 62 formed integrally in base 50. Shaft 58 and wheel 60 combine to provide an uncomplicated transmission, which could incorporate appropriate gearing (not shown), so that motor 54 may be of selectively variable torque and speed characteristics.

Treadmill 38 is provided with a second motor 64 and a second transmission 66 comprising shaft, pulleys, and drive belt. A cable 68 incorporating a plug 70 for connection to household AC power terminates at a central point generally indicated at 72.

Mobile controller 46 is connected by cable 44 to the electrical system also at 72. Interconnections located at 72 will be described hereinafter. Controller 46 includes switches of well known construction, indicated herein by their respective control buttons 74, for controlling motors 54 and 64. Motors 54 and 64 may independently be operated in either direction and stopped. Thus, foot platform 12 may rotate clockwise or counterclockwise, or may be stationary. Similarly, treadmill 38 may operate forwardly or backwardly, or may be stationary. In another embodiment, it is possible that either motor 54 or 64, or both, be operable in only one direction, or at variable speeds. Regardless of the combinations and permutations of operating characteristics, influence over any operating characteristic will be referred to as controlling the respective motor.

Track and roller assembly 32 includes a plurality of upper rollers 78A which contact upper surface 80A of track 34, and corresponding lower rollers 78B which contact surface 80B. Support plate 82 is constrained by entrapment to ride along track 34, holding support member 14 in its upright orientation by gussets 83.

It will be recalled from FIG. 1 that knob 36 controls a locking assembly, further components being visible in FIG. 2. Arms 84 mounted to the shaft of knob 36 interfere with rollers 78A,78B when knob 36 is rotated. Arms 84 are immobilized by friction, and substantially prevent wheels 78A,78B from rotating, and thus supporting member 14 is effectively locked at a selected position along track and roller assembly 32.

FIG. 2 also shows a preferred configuration of backboard 20, and further illustrates the normal position of a punching bag 86 attached thereto. Backboard 20 is generally a frustoconical disc, except that as viewed in side elevation, the inclined surfaces of the disc are curved. The center of the frustoconical disc points downwardly, and includes a conventional eye (not shown) for securing punching bag 86 thereto. This configuration most effectively minimizes the likelihood of impact of a user's hand therewith after a blow, while enabling rebound of punching bag 86.

Figure 3:
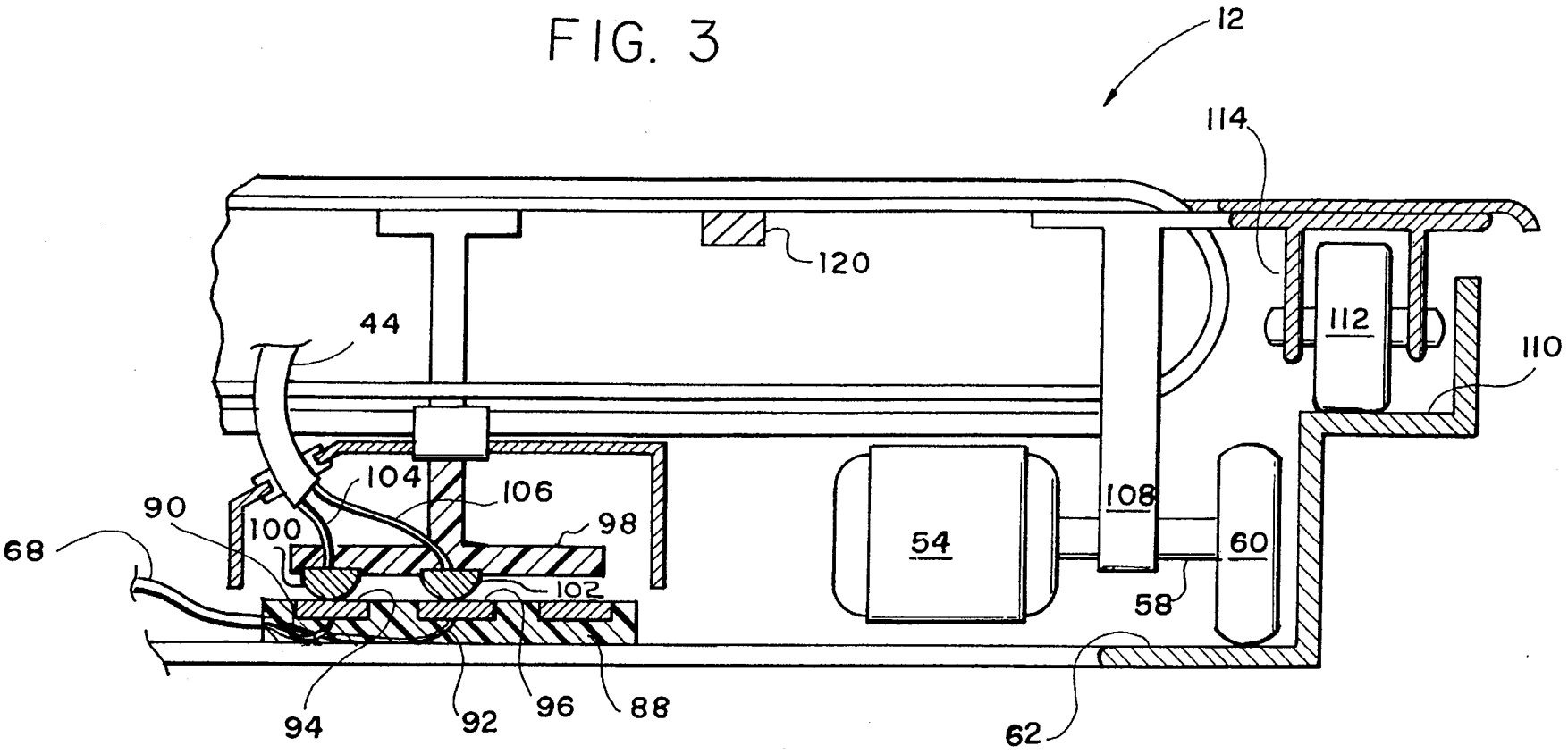
FIG. 3 is a side elevational detail view of the lower left of FIG. 2, drawn to enlarged scale.

FIG. 3 shows a rotary electrical connection and supporting and rotating components of foot platform 12 in greater detail. Cable 68 is connected to a stationary member 88, and conductors 90,92 are connected to respective terminals 94,96. A corresponding mobile member 98, attached to foot platform 12, has brushes 100,102 which contact terminals 94,96. Conductors 104,106 of cable 44 conduct power to controller 46 (see FIG. 1). Other conductors (not shown) conduct power as is appropriate and well known in the electrical arts to operate motors 54,64 as described above.

It will be readily appreciated that although power is shown as being derived by cord and plug connection to household AC power, it would be possible to provide batteries to the same effect. Also, controller 46 could be replaced by a remote controller (not shown), operating by radio waves or infrared energy. A preprogrammed controller (not shown) could also be provided. Both alternative embodiments would render cable 44 unnecessary.

FIG. 3 also shows details of motor 54 and its associated wheel 60. Shaft 58 is journaled at bracket 108, which is solidly attached to rotatable structural components of foot platform 12. Track 62 is shown, as is a supplementary track 110 bearing significant weight imposed on foot platform 12 when a user is standing thereon by a wheel 112 attached to foot platform 12 by a bracket 114. Angle irons 120 are mounted to base 50 to provided additional support for tracks 40 of the treadmill 38.

Referring again to FIG. 1, a lifting assembly 122 is provided to permit lifting of the top surface 124 of foot platform 12 thereby allowing access to the internal components of foot platform 12. Eyelets 126 are spaced about the circumference of the top surface of foot platform 12. A spool 128, having a handle 130 attached thereto, is mounted to vertical mast 16. A cable 132 is wound around spool 128. To remove top surface 124, cable 132 is threaded up vertical mast 16 and through a central opening 134 in backboard 20. Cable 132 is then secured to each of eyelets 126 and top surface 124 may be lifted by rotating handle 130. Handle 130 provides a mechanical advantage to aid in lifting top surface 124. Pulleys (not shown) may be provided at each point where cable 132 changes direction to aid in lifting the top surface 124 and reduce wear on cable 132.

It is to be understood that the present invention is not limited to the embodiments described above, but encompasses any and all embodiments within the scope of the following claims.

I claim:

1. A boxing and martial arts training device including:

a base adapted to be supported on a support surface, said base including a rotatable foot platform, a first motor and a first transmission connected thereto and adapted to horizontally rotate said platform about a vertical axis, said platform further including a treadmill connected to and adapted to rotate with said platform and a second motor and a second transmission connected to and adapted to rotate a tread of said treadmill, a second motor and a second transmission secured thereon for rotating said treadmill, and a controller connected to said motor and to said second motor for controlling said motor and said second motor; and a support member anchored to said base and a backboard for a punching bag attached to said support member, said support member comprising a vertical mast, said support member having means for fastening the punching bag thereto and securing the punching bag to said training device at a predetermined height above said foot platform.

2. The boxing and martial arts training device according to claim 1, further comprising means for adjustably mounting said mast to said base.

3. The boxing and martial arts training device according to claim 1, further including a controller controlling said first motor.

4. The boxing and martial arts training device according to claim 1, further including a controller controlling said motor and said second motor.

5. The boxing and martial arts training device according to claim 1, said support member comprising a gear assembly for raising and lowering said backboard on said mast, and a manual locking device for maintaining said backboard at the predetermined height above said foot platform.

6. The boxing and martial arts training device according to claim 1, said backboard comprising a frustoconical disc having a downwardly oriented center, said punching bag fastened to said frustoconical disc at said center thereof, whereby said frame includes a supporting surface providing a backboard for said punching bag which minimizes impact when a user delivers a blow to said punching bag.

7. The boxing and martial arts training device according to claim 1, said base further comprising an eye, whereby a double ended martial arts bag is anchored at said support member and at said base.

8. The boxing and martial arts training device according to claim 2, said means for adjustably mounting said mast to said base comprising a track and roller assembly fixed to said base and extending horizontally therefrom, said support member adjustably mounted on said track and roller assembly so as to move horizontally therealong, whereby said support member is moved away from and toward said base.

9. The boxing and martial arts training device according to claim 8, said track and roller assembly further including means for locking said support member at a selected position therealong.

10. A boxing and martial arts training device including:

a platform about a vertical axis, a motor and transmission secured thereon for rotating a base adapted to be supported on a support surface, said base including a rotatable foot platform, a first motor and a first transmission connected thereto and adapted to horizontally rotate said platform about a vertical axis, said platform further including a treadmill connected to and adapted to rotate with said platform and a second motor and a second transmission connected to and adapted to rotate a tread of said treadmill, a second motor and a second transmission secured thereon for rotating said treadmill, and a controller connected to said motor and to said second motor for controlling said motor and said second motor; and a support member anchored to said base and a backboard for a punching bag attached to said support member, said support member comprising a vertical mast, said support member having means for fastening the punching bag thereto and securing the punching bag to said training device at a predetermined height above said foot platform, and for securing said punching bag to said training device at a predetermined height above said foot platform, said support member comprising a gear assembly for raising and lowering said backboard on said mast, and a manual locking device for maintaining said backboard at the predetermined height above said foot platform, said training device further comprising a track and roller assembly fixed to said base and extending horizontally therefrom, said support member adjustably mounted on said track and roller assembly so as to move therealong, whereby said support member is moved away from and toward said base, said track and roller assembly further including means for locking said support member at a selected position therealong.

11. The boxing and martial arts training device according to claim 10, said backboard being frustoconical in shape and having a downwardly oriented center, said punching bag being fastened to said frustoconical shaped back board at said center thereof fastened to said frustoconical disc at said center thereof, whereby said frame includes a supporting surface providing a backboard for said punching bag which minimizes likelihood of impact therewith when a user delivers a blow to said punching bag.

12. The boxing and martial arts training device according to claim 10, said base further comprising an eye, whereby a double ended martial arts bag is anchored at said support member and at said base.

* * * * *